US010800171B2

(12) United States Patent
Taniyama

(10) Patent No.: US 10,800,171 B2
(45) Date of Patent: Oct. 13, 2020

(54) LIQUID DISCHARGE DEVICE AND LIQUID DISCHARGE APPARATUS

(71) Applicant: Masaki Taniyama, Osaka (JP)

(72) Inventor: Masaki Taniyama, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/212,034

(22) Filed: Dec. 6, 2018

(65) Prior Publication Data

US 2019/0283422 A1 Sep. 19, 2019

(30) Foreign Application Priority Data

Mar. 16, 2018 (JP) ..... 2018-049889

(51) Int. Cl.
*B41J 2/045* (2006.01)
*B41J 2/14* (2006.01)

(52) U.S. Cl.
CPC ..... *B41J 2/04581* (2013.01); *B41J 2/04588* (2013.01); *B41J 2/14274* (2013.01); *B41J 2002/14403* (2013.01); *B41J 2202/12* (2013.01)

(58) Field of Classification Search
CPC B41J 2/04581; B41J 2/14274; B41J 2/04588; B41J 2002/14403; B41J 2202/12
See application file for complete search history.

(56) References Cited

U.S. PATENT DOCUMENTS 6,050,678 A * 4/2000 Yoshida ..... B41J 2/14274 347/70
2012/0092417 A1* 4/2012 Kumagai ..... B41J 2/14274 347/47
2015/0062255 A1 3/2015 Sasaki
2017/0157920 A1 6/2017 Taniyama

FOREIGN PATENT DOCUMENTS

JP 2002-046265 2/2002
JP 2013-212660 10/2013
JP 2014-210357 11/2014
WO WO2007/097154 A1 8/2007

* cited by examiner

*Primary Examiner* — Geoffrey S Mruk
(74) *Attorney, Agent, or Firm* — Harness, Dickey & Pierce, P.L.C.

(57) ABSTRACT

A liquid discharge device includes a nozzle plate including nozzles to discharge liquid; individual liquid chambers communicating with nozzles; a common liquid chamber to supply the liquid to the individual liquid chambers; a circulation channel; a common circulation chamber; a pressure generator to apply pressure to the liquid; and circuitry to apply, to the pressure generator, a predetermined drive waveform in which an electric potential is changed, from a first potential to apply an initial pressure to the liquid, to a second potential, and the second potential is kept to a predetermined timing for liquid discharging. At the predetermined timing, a discharge speed difference, caused when the initial pressure is changed in a case where the predetermined drive waveform is applied with the initial pressure (Continued)

applied to the liquid, is a local minimum. The initial pressure is applied to the liquid in a state without the predetermined drive waveform.

14 Claims, 14 Drawing Sheets

LIQUID DISCHARGE DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-049889, filed on Mar. 16, 2018, in the Japan Patent Office, the entire disclosure of which is hereby incorporated by reference herein.

BACKGROUND

Technical Field

The present disclosure relates to a liquid discharge apparatus and a liquid discharge device.

DESCRIPTION OF THE RELATED ART

As One Type of a Liquid Discharge Head (a Droplet Discharge Head) to Discharge Liquid, there is a circulation-type head in which liquid is circulated through a plurality of individual liquid chambers.

In the circulation-type liquid discharge head, for example, when liquid that dries easily is used, the flow rate of the liquid to be circulated is increased. In such a case, the discharge speed of liquid may vary among the plurality of individual liquid chambers.

SUMMARY

An embodiment of this disclosure provides a liquid discharge device including a nozzle plate including a plurality of nozzles configured to discharge liquid; a plurality of individual liquid chambers communicating with the plurality of nozzles, respectively; a common liquid chamber configured to supply the liquid to the plurality of individual liquid chambers; a circulation channel communicating with the plurality of individual liquid chambers; a common circulation chamber communicating with the circulation channel; a pressure generator configured to apply pressure to the liquid in each of the plurality of individual liquid chambers; and circuitry. The circuitry is configured to apply a predetermined drive waveform to the pressure generator. In the predetermined drive waveform, an electric potential is changed, from a first potential to apply an initial pressure to the liquid in each of the plurality of individual liquid chambers, to a second potential different from the first potential, and the second potential is kept to a predetermined timing at which the electrical potential is changed to a potential for discharging the liquid. The predetermined timing is such a timing that a difference in discharge speed of the liquid is a local minimum. The difference in discharge speed is the difference caused by changing the initial pressure when the predetermined drive waveform is applied with the initial pressure applied to the liquid. The initial pressure is pressure applied to the liquid in a state without application of the predetermined drive waveform.

Another embodiment provides a liquid discharge apparatus including the above-described liquid discharge device.

In another embodiment, a liquid discharge device includes the nozzle plate including the plurality of nozzles, the plurality of individual liquid chambers, the common liquid chamber, the circulation channel, the common circulation chamber, and the pressure generator described above.

The liquid discharge device further includes circuitry configured to apply, to the pressure generator, a predetermined drive waveform in which an electric potential is changed, from a first potential to apply an initial pressure to the liquid in each of the plurality of individual liquid chambers, to a second potential different from the first potential, and the second potential is kept to a predetermined timing at which the electrical potential is changed to a potential for discharging the liquid. The predetermined timing is such a timing at which a difference in discharge speed of the liquid, which is caused by a difference in an initial meniscus pressure, is a local minimum. The initial meniscus pressure is pressure applied to an interface between the liquid and gas at each of the plurality of nozzles in a state without application of the predetermined drive waveform.

Another embodiment provides a liquid discharge apparatus including the above-described liquid discharge device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
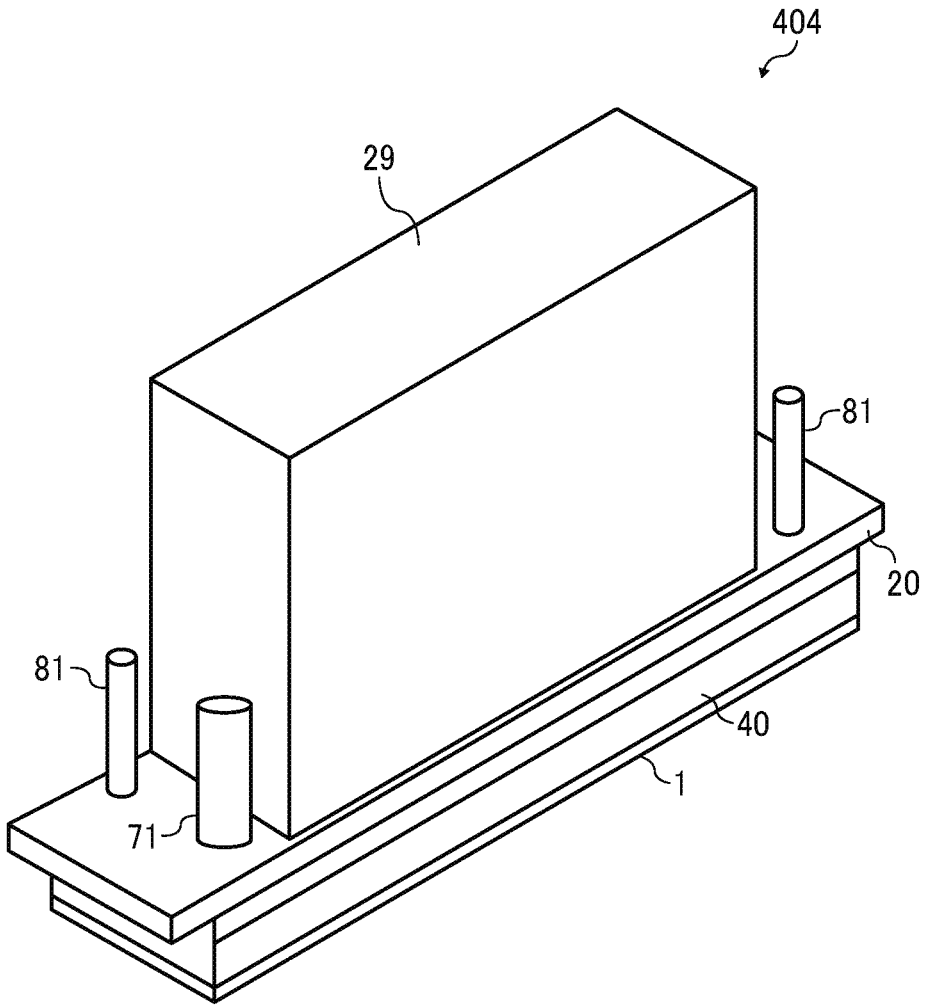
FIG. 1 is an outer perspective view of a liquid discharge head according to one embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However; the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

Embodiment 1

Figure 2:
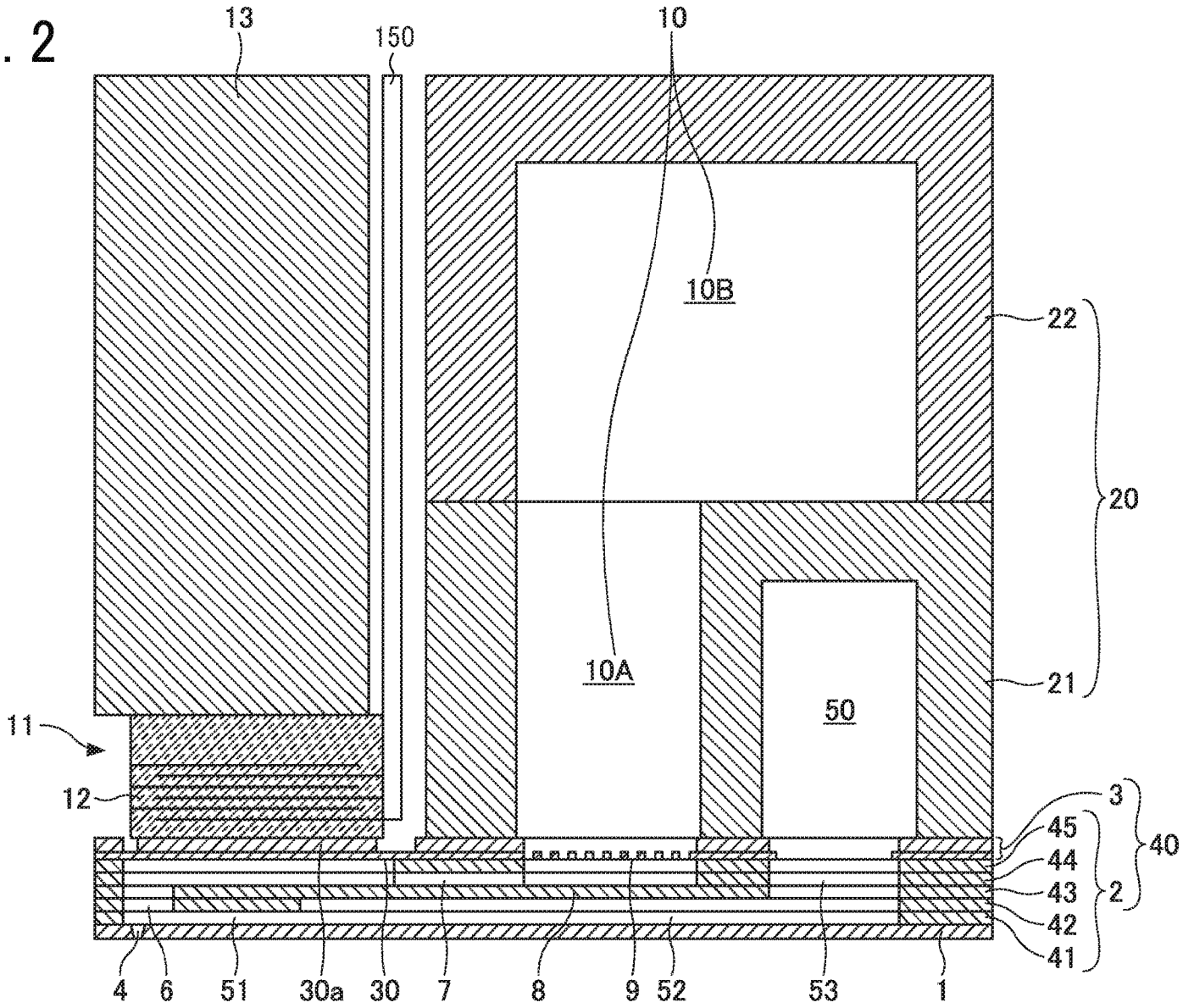
FIG. 2 is a cross-sectional view of the liquid discharge head illustrated in FIG. 1 cut along a direction perpendicular to a nozzle array direction.
Figure 3:
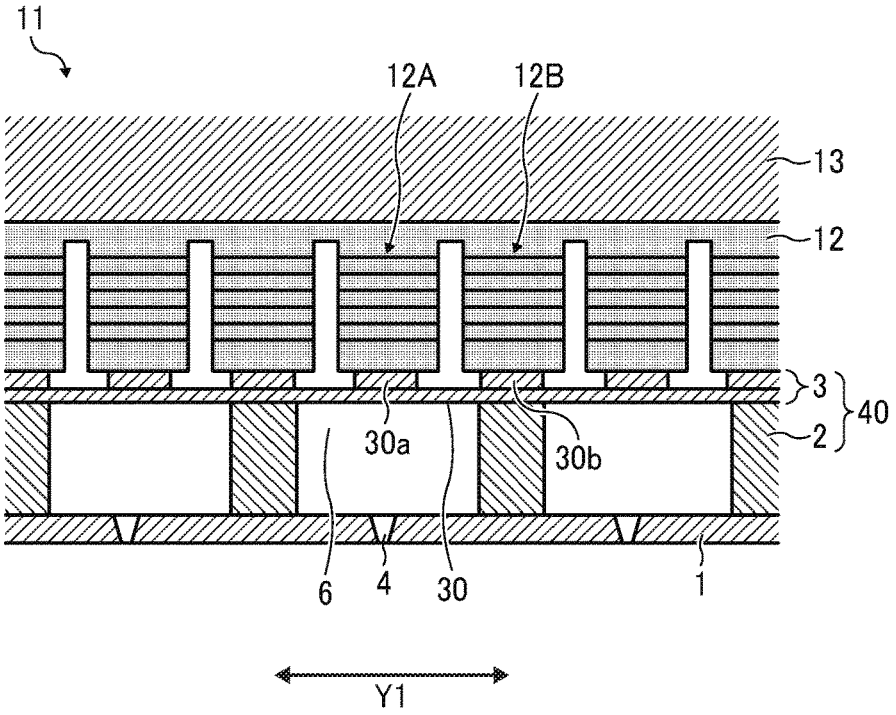
FIG. 3 is a cross-sectional view of the liquid discharge head illustrated in FIG. 2 cut along a direction parallel to the nozzle array direction.
Figure 4:
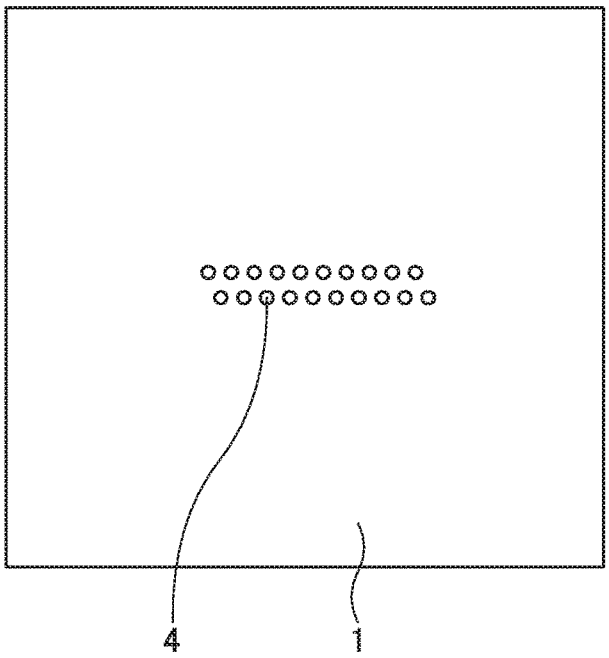
FIG. 4 is a plan view of a portion of a nozzle plate of the liquid discharge head illustrated in FIG. 2.

Embodiments according to the present disclosure will be described below, with reference to the accompanying drawings. Descriptions are given below of an example liquid discharge head according to the present embodiment, with reference to FIGS. 1 to 6. FIG. 1 is an outer perspective view of the liquid discharge head according to the present embodiment. FIG. 2 is a cross-sectional view of the liquid discharge head cut along a direction perpendicular to a nozzle array direction indicated by arrow Y1 in FIG. 3. FIG. 3 is a cross-sectional view of the liquid discharge head cut along a direction parallel to the nozzle array direction indicated by arrow Y1. FIG. 4 is a plan view of a nozzle plate of the liquid discharge apparatus. FIGS. 5A to 5F are plan views illustrating components of a liquid channel substrate of the liquid discharge head. FIGS. 6A and 6FB are plan views illustrating components of a common-chamber substrate of the liquid discharge head.

A liquid discharge head 404 illustrated in FIG. 1 includes a nozzle plate 1, a channel substrate 2, and a diaphragm member 3 that are laminated one on another and bonded to each other. The diaphragm member 3 serves as a wall member. Hereinafter, the "liquid discharge head" may be simply referred to as "head". The liquid discharge head 404 includes piezoelectric actuators 11 to displace the diaphragm member 3, a common-chamber substrate 20, and a cover 29.

The nozzle plate 1 includes a plurality of nozzles 4 to discharge liquid.

The channel substrate 2 includes individual liquid chambers 6 communicating with the nozzles 4, fluid restrictors 7 communicating with the individual liquid chambers 6, and liquid introduction portions 8 communicating with the fluid restrictors 7. The channel substrate 2 is formed of a plurality of plates 41 to 45 stacked one on another from the side of the nozzle plate 1. The plates 41 to 45 and the diaphragm member 3 are stacked and joined together into a channel member 40.

The diaphragm member 3 includes a filter portion 9 serving as openings through which the liquid introduction portions 8 communicate with a common liquid chamber 10 defined by the common-chamber substrate 20.

The diaphragm member 3 is a wall member that forms wall faces of the individual liquid chambers 6 of the channel substrate 2. In the present embodiment, the diaphragm member 3 has, but not limited to, a double-layer structure and includes a first layer serving a thin portion and a second layer serving as a thick portion from the side of the channel substrate 2. The first layer includes deformable vibration portions 30 positioned corresponding to the individual liquid chambers 6.

As illustrated in FIG. 4 as well, the plurality of nozzles 4 is arranged in a staggered pattern on the nozzle plate 1.

Figure 5A:
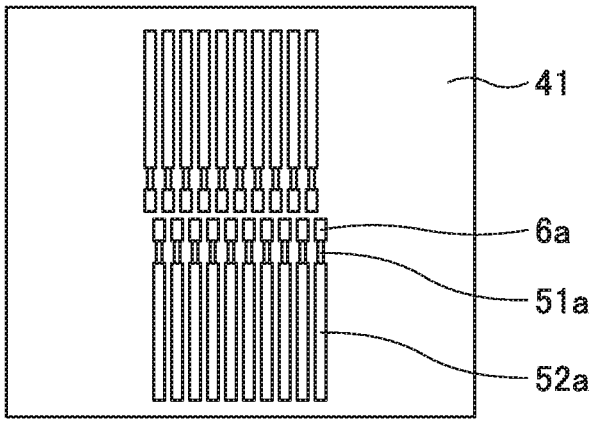
FIGS. 5A to 5F are plan views illustrating components of a liquid channel substrate of the liquid discharge head illustrated in FIG. 2.
Figure 6A:
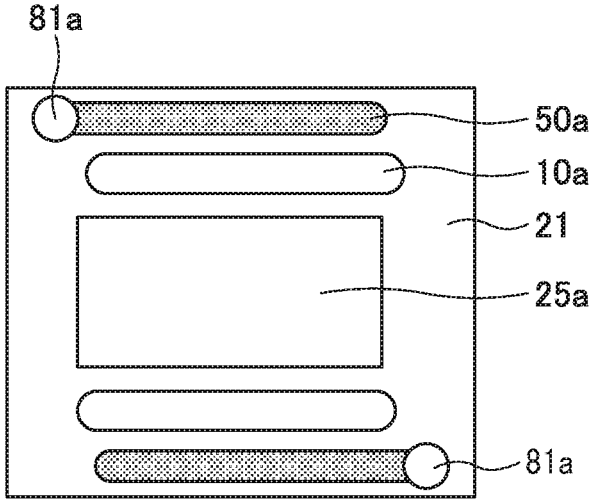
FIGS. 6A and 6B are plan views illustrating components of a common-chamber substrate of the liquid discharge head illustrated in FIG. 2.

As illustrated in FIG. 5A, the plate 41 forming the channel substrate 2 includes through grooves 6*a* and through grooves 51*a* and 52*a*. The term "through groove" used in the present specification represents a groove-shaped through hole. The through grooves 6*a* serve as the individual liquid chambers 6. The through grooves 51*a* serve as fluid restrictors 51, and the through grooves 52*a* serve as a circulation channel 52.

Figure 5B:
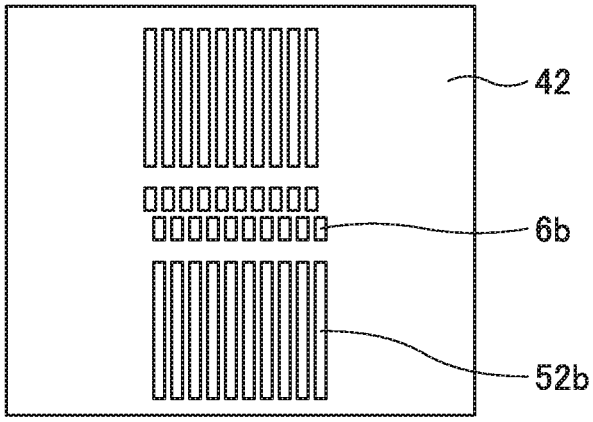

Similarly, as illustrated in FIG. 5B, the plate 42 includes through grooves 6*b* serving as the individual liquid chambers 6 and through grooves 52*b* serving as the circulation channel 52.

Figure 5C:
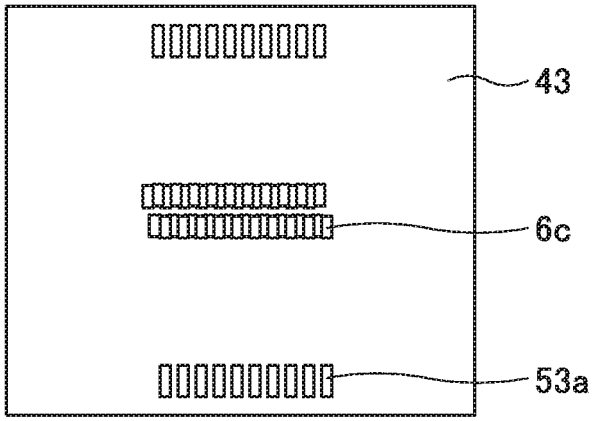

Similarly, as illustrated in FIG. 5C, the plate 43 includes through grooves 6*c* serving as the individual liquid chambers 6 and through grooves 53*a* serving as a circulation channel 53. The longitudinal direction of the through groove 53*a* is in the nozzle array direction.

Figure 5D:
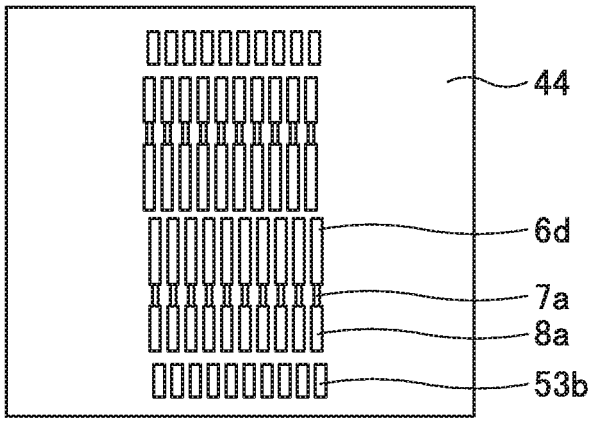

Similarly, as illustrated in FIG. 5D, the plate 44 includes through grooves 6*d* serving as the individual liquid chambers 6, through grooves 7*a* serving as the fluid restrictors 7, through grooves 8*a* serving as the liquid introduction portions 8, and through grooves 53*b* serving as the circulation channel 53. The longitudinal direction of the through groove 53*b* is in the nozzle array direction.

Figure 5E:
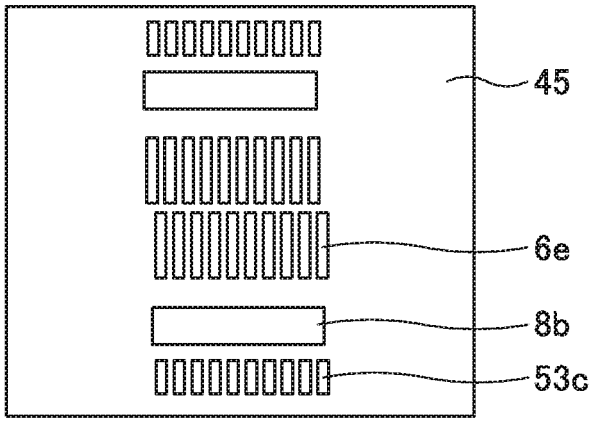

Similarly, as illustrated in FIG. 5E, the plate 45 includes through grooves 6*e* serving as the individual liquid chambers 6, through grooves 8*b* (post-filter liquid chamber downstream from the filter portion 9) serving as the liquid introduction portion 8, and through grooves 53*c* serving as the circulation channel 53, The longitudinal direction of the through grooves 8*b* and that of the through groove 53*c* are in the nozzle array direction.

Figure 5F:
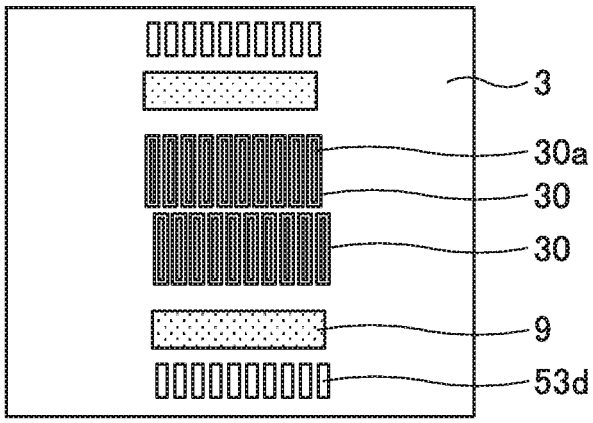

As illustrated in FIG. 5F, the diaphragm member 3 includes vibration portions 30, the filter portions 9, and through grooves 53*d* serving as the circulation channel 53. The longitudinal direction of the through groove 53*d* is in the nozzle array direction.

In this way, as a plurality of plates are stacked and bonded together into a channel member, a complicated channel can be defined with a simple configuration.

With the above-described configuration, the fluid restrictors 51 disposed along the surface of the channel substrate 2 communicating with the individual liquid chambers 6 are formed in the channel member 40 including the channel substrate 2 and the diaphragm member 3. Further, the circulation channel 52 and the circulation channel 53 extending in the thickness direction of the channel member 40 and communicating with the circulation channel 52 are formed in the channel member 40. The circulation channel 53 leads to a common circulation chamber 50 to be described later.

On the other hand, the common-chamber substrate 20 defines the common liquid chamber 10 to which the liquid is supplied from a supply and circulation device 494 and the common circulation chamber 50. The common-chamber substrate 20 includes a first common-chamber member 21 and a second common-chamber member 22.

As illustrated in FIG. 6A, the first common-chamber member 21 of the common-chamber substrate 20 includes a through hole 25*a* for a piezoelectric actuator, through grooves 10*a* serving as a downstream common liquid chamber 10A, and grooves 50*a* serving as the common circulation chamber 50. The groove 50*a* has a bottom.

Figure 6B:
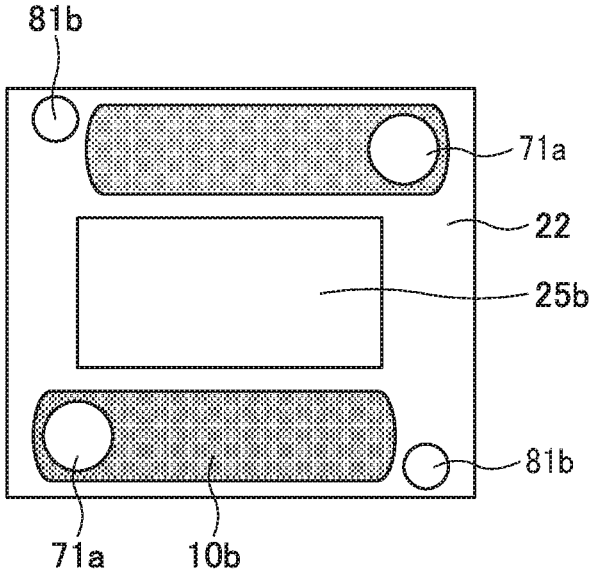

Similarly, as illustrated in FIG. 6B, the second common-chamber member 22 includes a through hole 25*b* for a piezoelectric actuator and grooves 10*b* serving as an upstream common liquid chamber 10B.

Referring also to FIG. 1, the second common-chamber member 22 includes a through hole 71*a*. The through hole 71*a* serves as a supply inlet through which one end of the common liquid chamber 10 in the nozzle array direction communicates with a supply port 71.

Similarly, the first common-chamber member 21 and the second common-chamber member 22 include through holes 81*a* and 81*b*, respectively, through which the other end (opposite the through holes 71*a*) of the common circulation chamber 50 in the nozzle array direction communicates with a circulation port 81.

Note that, in FIGS. 6A and 6B, a groove having a bottom is indicated with hatching, which is similar in the subsequent drawings.

Thus, the common-chamber substrate 20 includes the first common-chamber member 21 and the second common-chamber member 22. The first common-chamber member 21 is bonded to a side of the channel member 40 facing the diaphragm member 3. The second common-chamber member 22 is laminated on and bonded to the first common-chamber member 21.

The first common-chamber member 21 defines the downstream common liquid chamber 10A and the common circulation chamber 50. The downstream common liquid chamber 10A is a portion of the common liquid chamber 10 communicating with the liquid introduction portion 8. The common circulation chamber 50 communicates with the circulation channel 53. The second common-chamber member 22 defines the upstream common liquid chamber 10B that is a remaining portion of the common liquid chamber 10.

The downstream common liquid chamber 10A, which is a portion of the common liquid chamber 10, and the common circulation chamber 50 are disposed side by side in the direction perpendicular to the nozzle array direction. The common circulation chamber 50 is disposed within the common liquid chamber 10, when being projected.

Such placement is advantageous in that, the size of the common circulation chamber 50 is not restricted by the dimensions required for the channels including the individual liquid chambers 6, the fluid restrictors 7, and the liquid introduction portions 8 defined by the channel member 40.

Owing to the configuration in which the common circulation chamber 50 and a portion of the common liquid chamber 10 are disposed side by side and the common circulation chamber 50 is disposed to be projected inside the common liquid chamber 10, the width of the liquid discharge head 404 can be relatively small in the direction orthogonal to the nozzle array direction. Accordingly, the head can be compact. The common-chamber substrate 20 defines the common liquid chamber 10, to which the liquid is supplied from a head tank or a liquid cartridge, and the common circulation chamber 50.

The piezoelectric actuator 11 is disposed on a side of the diaphragm member 3 opposite a side facing the individual liquid chambers 6 (see FIG. 2). The piezoelectric actuator 11 includes electromechanical transducer elements as drivers (actuators or pressure generators) to deform the vibration portion 30 of the diaphragm member 3.

As illustrated in FIG. 3, the piezoelectric actuator 11 includes piezoelectric members 12 bonded on a base 13. The piezoelectric members 12 are grooved by half cut dicing so that each piezoelectric member 12 includes a desired number of pillar-shaped piezoelectric elements 12A and 12B arranged at regular intervals into a comb shape.

In the present embodiment, the piezoelectric elements 12A of the piezoelectric member 12 are driven by application of drive waveforms, and the piezoelectric elements 12B are used as supports to which no drive waveform is applied. Alternatively, in some embodiments, all of the piezoelectric elements 12A and 12B may be piezoelectric elements to be driven by application of drive waveforms.

The piezoelectric element 12A is joined to the projecting portion 30*a*, which is an island-shaped thick portion on the vibration portion 30 of the diaphragm member 3. The piezoelectric element 12B is bonded to a projecting portion 30*b*, which is a thick portion of the diaphragm member 3.

The piezoelectric member 12 includes piezoelectric layers and internal electrodes alternately laminated. The internal electrodes are lead out to an end face of the piezoelectric member 12 to form external electrodes. The external electrodes are coupled to a flexible wiring member 150.

In the liquid discharge head 404 thus configured, for example, as the voltage applied to the piezoelectric element 12A is lowered from a reference electric potential, the piezoelectric element 12A contracts. Accordingly, the vibration portion 30 of the diaphragm member 3 moves down in FIG. 3, and the volume of the individual liquid chamber 6 increases, thus causing the liquid to flow into the individual liquid chamber 6.

When the voltage applied to the piezoelectric element 12A is raised, the piezoelectric element 12A expands in the direction of lamination. The vibration portion 30 of the diaphragm member 3 deforms in a direction toward the nozzle 4 and reduces the volume of the individual liquid chambers 6. As a result, the liquid in the individual liquid chambers 6 is squeezed to be discharged from the nozzle 4.

When the voltage applied to the piezoelectric element 12A is returned to the reference electric potential, the vibration portion 30 of the diaphragm member 3 is returned to the initial position. Accordingly, the individual liquid chamber 6 expands to generate a negative pressure, thus replenishing the individual liquid chamber 6 with the liquid from the common liquid chamber 10. The piezoelectric elements 12A serve as a pressure generator configured to apply pressure to the liquid in the plurality of individual liquid chambers 6. After the vibration of a meniscus surface of the nozzle 4 decays to a stable state, the liquid discharge head 404 shifts to the discharge of a next droplet.

Note that the driving method of the head 404 is not limited to the above-described example (pull-push discharge). For example, pull discharge or push discharge may be performed in response to the manner of application of the drive waveform. In the description above, a laminated piezoelectric element is used as the pressure generator for applying fluctuations in pressure to the individual liquid chamber 6. Alternatively, aspects of the present disclosure can adapt to use of a thin film piezoelectric element. Yet alternatively, a heat element can be disposed in the individual liquid chamber 6 to generate bubbles by heat of the heat element to cause pressure fluctuation. Yet alternatively, an electrostatic force can be used to cause pressure fluctuation.

Next, descriptions are given below of an example configuration of a liquid circulation system 402 using the liquid discharge head 404 according to the present embodiment, with reference to FIG. 7.

Figure 7:
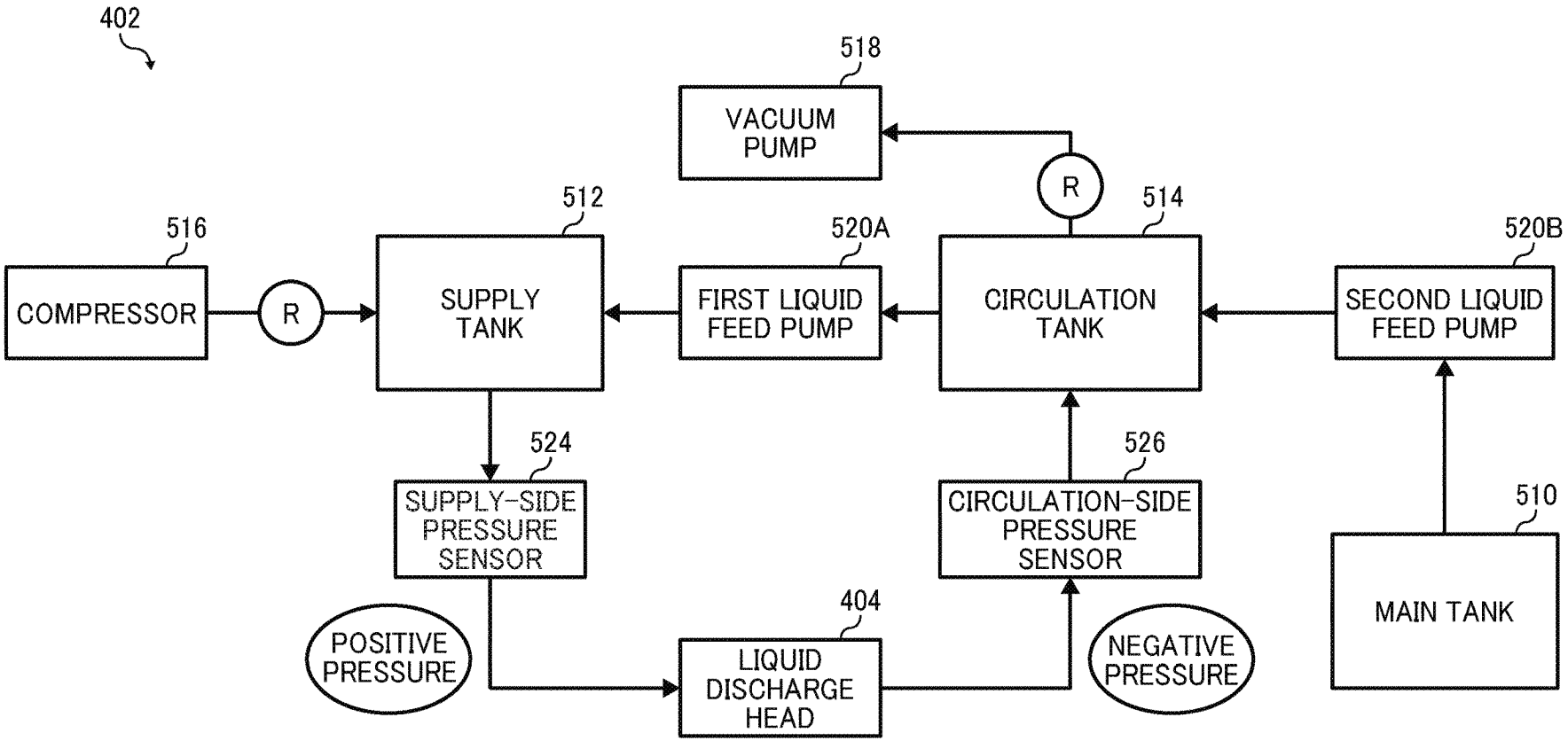
FIG. 7 is a block diagram of a liquid circulation system according to an embodiment.

FIG. 7 is a block diagram illustrating the liquid circulation system 402 according to the present embodiment.

As illustrated in FIG. 7, the liquid circulation system 402 includes, for example, a main tank 510, the liquid discharge head 404, a supply tank 512, a circulation tank 514, a compressor 516, a vacuum pump 518, a first liquid feed pump 520A, a second liquid feed pump 520B, regulators R, a supply-side pressure sensor 524, and a circulation-side pressure sensor 526. The supply-side pressure sensor 524 is disposed between the supply tank 512 and the liquid discharge head 404 and coupled to a supply channel coupled to the supply port 71 (see FIG. 1) of the liquid discharge head 404. The circulation-side pressure sensor 526 is disposed between the liquid discharge head 404 and the circulation tank 514 and is coupled to the side of the circulation channel coupled to the circulation ports 81 (see FIG. 1) of the liquid discharge head 404.

One end of the circulation tank 514 is coupled to the supply tank 512 via the first liquid feed pump 520A and the other end of the circulation tank 514 is coupled to the main tank 510 via the second liquid feed pump 520B. Accordingly, the liquid flows from the supply tank 512 into the liquid discharge head 404 via the supply port 71 and exits the liquid discharge head 404 from the circulation ports 81 into the circulation tank 514. Further, the first liquid feed pump 520A feeds the liquid from the circulation tank 514 to the supply tank 512. Thus, the liquid is circulated.

The supply tank 512 is coupled to the compressor 516 and controlled to keep the pressure detected by the supply-side pressure sensor 524 at a predetermined positive pressure. The circulation tank 514 is coupled to the vacuum pump 518 and controlled to keep the pressure detected by the circulation-side pressure sensor 526 at a predetermined negative pressure. Such a configuration allows the meniscus of liquid to maintain a constant negative pressure while circulating the liquid inside the liquid discharge head 404.

As the liquid discharge head 404 discharges droplets from the nozzles 4, the amount of liquid in the supply tank 512 and the circulation tank 514 decreases. Accordingly, preferably, the circulation tank 514 is replenished with the liquid fed from the main tank 510 by the second liquid feed pump 520B. The timing of replenishment of liquid from the main tank 510 to the circulation tank 514 can be controlled in accordance with a result of detection with a liquid level sensor in the circulation tank 514. For example, the liquid is supplied from the circulation tank 514 from the main tank 510 in response to a detection result that the liquid level in the circulation tank 514 is lower than a predetermined height.

Next, circulation of liquid in the liquid discharge head 404 will be described. As illustrated in FIG. 1, at the end of the common-chamber substrate 20, the supply port 71 communicating with the common liquid chamber 10 and the circulation port 81 communicating with the common circulation chamber 50 are disposed. The supply port 71 and the circulation port 81 are respectively coupled to the supply tank 512 and the circulation tank 514 (see FIG. 7) that store the liquid through tubes. The liquid stored in the supply tank 512 is supplied to the individual liquid chambers 6 via the supply port 71, the common liquid chamber 10, the liquid introduction portion 8, and the fluid restrictor 7.

While the liquid inside the individual liquid chamber 6 is discharged from the nozzle 4 by driving of the piezoelectric element 12, the liquid not discharged but staying in the individual liquid chamber 6 is either partially or entirely circulated, through the fluid restrictor 51, the circulation channel 52 and 53, the common circulation chamber 50, and the circulation port 81, to the circulation tank 514.

Note that the liquid can be circulated not only during operation of the liquid discharge head 404 but also during the suspension of the operation. Circulation during the suspension of operation can reduce agglomeration and sedimentation of components of the liquid while constantly refreshing the liquid in the individual liquid chambers 6.

A circulation-type liquid discharge head causes the liquid to flow at a predetermined flow rate or flow speed in order to circulate the liquid inside the liquid discharge head. The flow of the liquid causes pressure loss in the individual liquid chamber 6 of the liquid discharge head 404 in accordance with the width and length of the fluid restrictor 7, or the width and height of the individual liquid chamber 6, etc.

On the other hand, due to manufacturing error, the width and the like of the fluid restrictors 7 may vary among the plurality of individual liquid chambers 6 of the liquid discharge head 404. Such variations result in differences in pressure loss among the individual liquid chambers 6, causing variations in the discharge speed of the liquid discharged from among the individual liquid chambers 6. In particular, when the flow amount or the flow rate of the liquid to be circulated is increased, such variations become remarkable. If the discharge speed varies, the landing positions of the discharged liquid droplets differ among the individual liquid chambers 6, which may degrade the quality of image formed by a liquid discharge apparatus (e.g., an image forming apparatus) employing the liquid discharge head 404.

As described above, driving voltage given to the piezoelectric elements 12A (the pressure generator to apply pressure to the liquid in the individual liquid chambers 6) is changed to have a waveform having a predetermined pulse width, to discharge the liquid. In the present embodiment, the pulse width of the drive waveform is specified to reduce variations in liquid discharge speed among the individual liquid chambers 6 in the liquid discharge apparatus employing the circulation-type liquid discharge head 404. This will be described in detail below.

Figure 8:
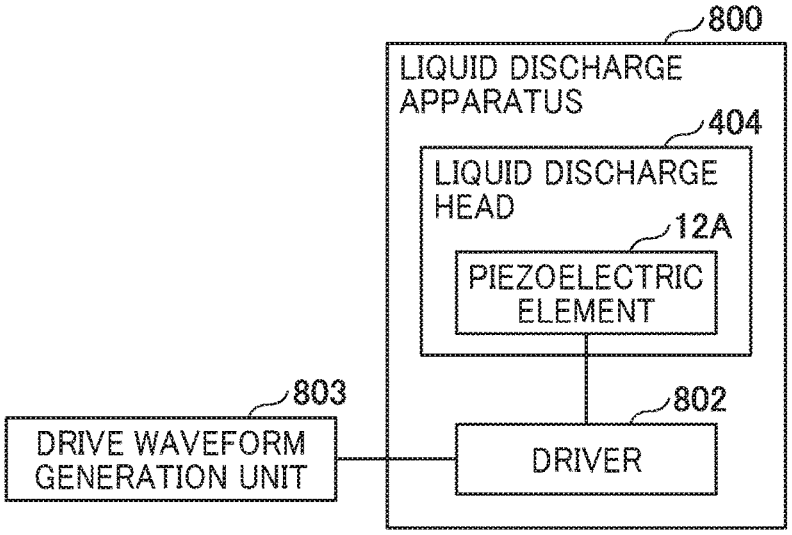
FIG. 8 is a block diagram illustrating a functional configuration of a liquid discharge apparatus according to an embodiment.

First, descriptions are given below of a functional configuration of a liquid discharge apparatus 800 according to the present embodiment, with reference to a block diagram of FIG. 8.

The liquid discharge apparatus 800 includes the liquid discharge head 404 and a driver 802. As described above, the liquid discharge head 404 is of circulation type and includes the piezoelectric elements 12A.

The driver 802 receives a drive waveform having a predetermined pulse width from a drive waveform generation unit 803 and outputs the drive waveform to the piezoelectric element 12A of the liquid discharge head 404. The piezoelectric element 12A applies pressure to the liquid in the individual liquid chamber 6 according to the input drive waveform. With such pressure, the liquid is discharged from the individual liquid chamber 6. The driver 802 can be realized by, for example, an electric circuit or the like to output a driving signal such as a driving voltage to the piezoelectric element 12A according to an input signal. The piezoelectric element 12A is a typical example of the pressure generator.

Next, the drive waveform applied to the piezoelectric element 12A will be described with reference to FIG. 9. Note that the drive waveform is a change with time of the driving voltage.

Figure 9:
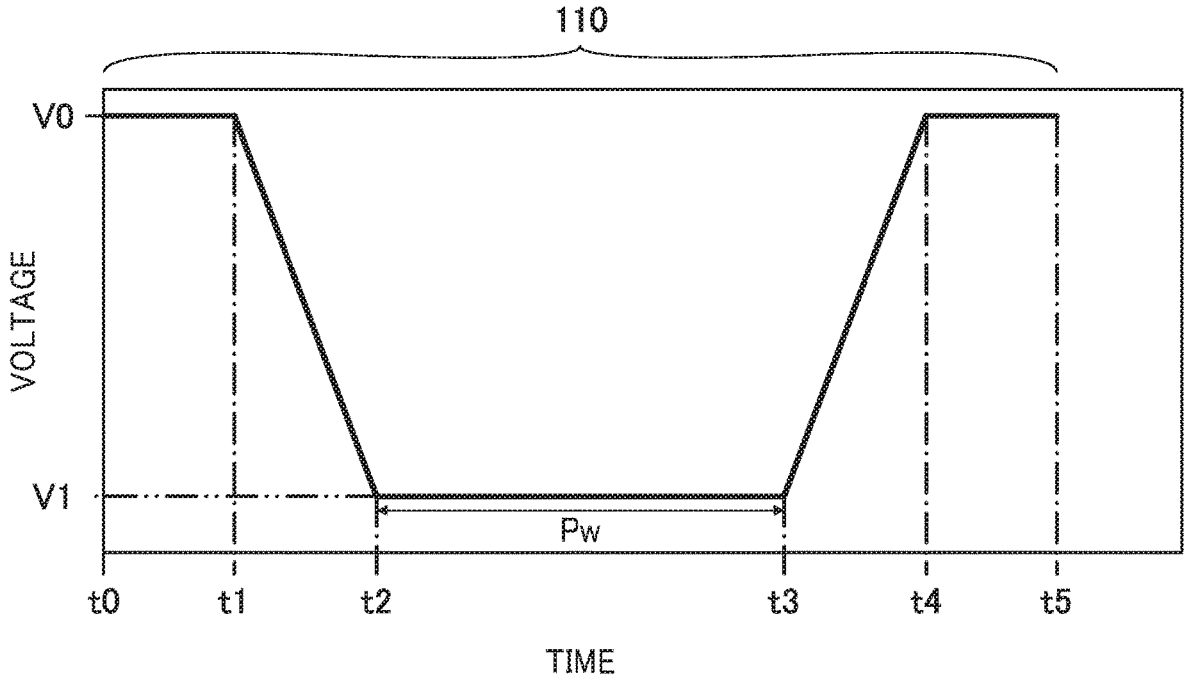
FIG. 9 is a graph illustrating an example drive waveform applied to a piezoelectric element according to an embodiment.

FIG. 9 illustrates an example drive waveform applied to the piezoelectric element 12A. In FIG. 9, the horizontal axis represents elapse of time, the vertical axis represents voltage. Time points t0 to t5 indicated by alternate long and short dashed lines are timings at which the voltage is changed. Voltages V0 to V1 indicated by two-dot chain lines are voltages at each timing. A drive waveform 110 is a drive waveform for one period.

From time point t0 to time point t1, the voltage V0 having the reference electric potential (a first potential) is applied to the piezoelectric element 12A. The reference electric potential is a direct current (DC) voltage applied to the piezoelectric element 12A while the drive waveform is not applied to the liquid discharge head 404 and the liquid discharge head 404 is not operating.

Then, during the period from time point t1 to time point t2, the voltage is instantaneously lowered from the voltage V0 to the voltage V1. As a result, a negative pressure is generated in the individual liquid chamber 6. Due to the negative pressure, the liquid vibrates with pressure according to a natural vibration period Tc. The term "natural vibration" is a characteristic vibration that acts on a vibration system when the vibration system vibrates freely, and the term "natural vibration period" is the period of natural vibration. The natural vibration period Tc is the natural vibration period of the liquid in the individual liquid chamber 6.

Subsequently, during the period from time point t2 to time point t3, the voltage V1 is maintained. The duration in which the voltage V1 (serving as a second potential) is thus maintained is called a pulse width. In the example illustrated in FIG. 9, the time from time point t2 to time point t3 during which the voltage V1 is maintained is a pulse width Pw (the predetermined pulse width).

Subsequently, during the period from time point t3 to time point t4, the voltage is raised sharply to the voltage V0 being the reference potential. At this time, a positive pressure is generated in the individual liquid chamber 6, and liquid is discharged from the nozzle 4 by the positive pressure.

The speed of the liquid discharged from the nozzle 4 of the individual liquid chamber 6 is referred to as "discharge speed Vj". The discharge speed Vj varies according to the difference between the voltage V0 and the voltage V1, the pulse width Pw, and the like.

Since the liquid in the individual liquid chamber 6 vibrates with pressure, the negative pressure applied to the liquid in the individual liquid chamber 6 periodically comes to a peak and an opposite peak, that is, a local maximum and a local minimum. At the timing of the peak of the negative pressure in the individual liquid chamber 6, the voltage is raised from V1 to V0, and a positive pressure is applied to the liquid in the individual liquid chamber 6. Then, the liquid enters a state in which pressure vibration is most efficiently utilized, that is, a resonance state. The timing at which the negative pressure on the liquid in the individual liquid chamber 6 reaches the peak depends on the natural vibration period Tc. Normally, the pulse width is determined according to the natural vibration period Tc.

Figure 10:
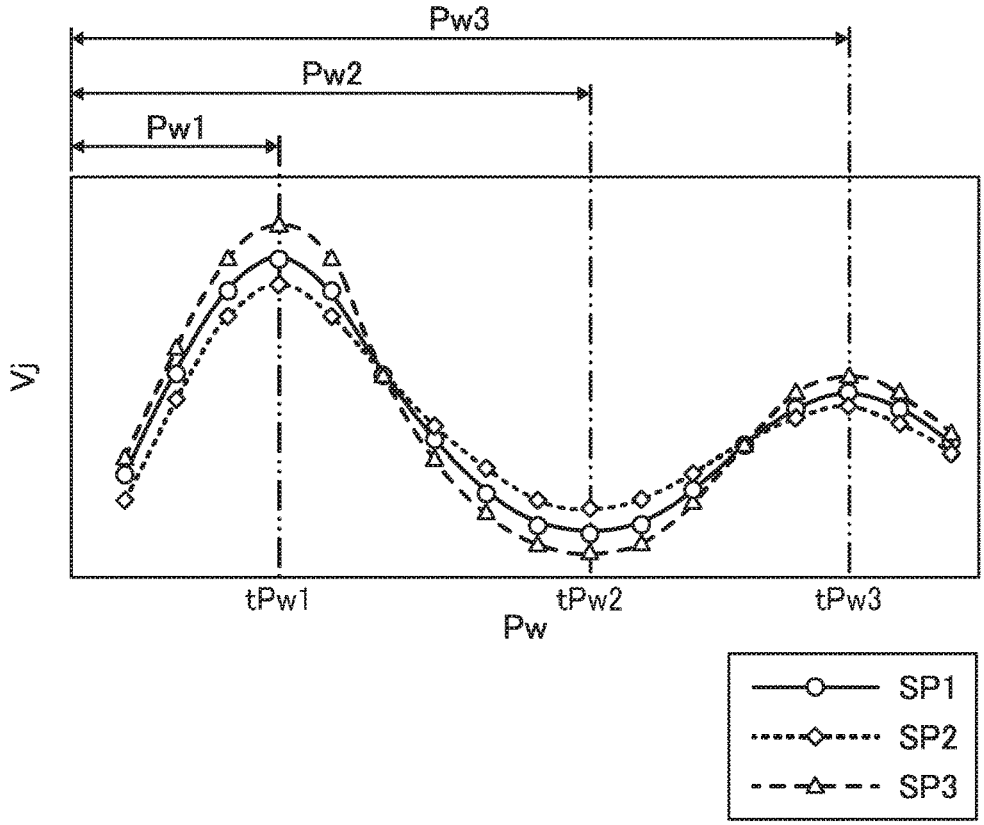
FIG. 10 is a graph for explaining example changes in a liquid discharge speed with elapse of time (pulse width) in which a voltage value is maintained.

FIG. 10 illustrates changes in the discharge velocity Vj of liquid when the pulse width Pw is changed (the voltages V0 and V are unchanged) in the drive waveform 110. The horizontal axis represents the pulse width Pw, that is, period of application of the voltage V1 (the second potential), and the vertical axis represents the discharge speed Vj of liquid. As illustrated in the figure, the discharge speed Vj varies depending on the pulse width Pw, reaches local maximums with the pulse widths Pw1 and Pw3, and reaches a local minimum with the pulse width Pw2.

The discharge speed at the timing tPw1 (the pulse width Pw1) is referred to as "first resonance peak speed", and the speed at the timing tPw3 (the pulse width Pw3) is referred to as "second resonance peak speed". On the other hand, the discharge speed at the timing Pw2 (the pulse width Pw2) is referred to as "first resonance opposite-peak speed". The first resonance peak speed is the speed of liquid discharged by a positive pressure applied at the timing at which the negative pressure on the liquid in the individual liquid chamber 6 reaches a first peak. The second resonance peak speed is the speed of liquid discharged by a positive pressure applied at the timing of second peak. The first resonance opposite-peak speed is speed of liquid discharged by a positive pressure applied at the timing at which the negative pressure on the liquid in the individual liquid chamber 6 reaches a first opposite peak.

The three graphs illustrated in FIG. 10 illustrate the change of the liquid discharge speed Vj with length of the pulse width Pw when the initial pressure on the liquid in the individual liquid chamber 6 is set to pressure values SP1, SP2, and SP3 (SP3<SP1<SP2). The initial pressure on the liquid in the individual liquid chamber 6 is the pressure applied to the liquid in the individual liquid chamber 6 in a state where the drive waveform 110 is not applied to the piezoelectric element 12A. In the state where the drive waveform 110 is not applied to the piezoelectric element 12A, the voltage V0 having the reference potential (the first potential) is applied to the piezoelectric element 12A. Therefore, the initial pressure on the liquid in the individual liquid chamber 6 can be referred to as the pressure applied to the liquid in the individual liquid chamber 6 in a state where the voltage V0 having the reference potential (the first potential) is applied to the piezoelectric element 12A.

Further, the liquid discharge head 404 according to the present embodiment is of the circulation type, and, in the liquid discharge head 404, a constant negative pressure at the meniscus is maintained while the liquid is circulated through the liquid discharge head 404, as described above. The above-mentioned initial pressure is caused in a state in which the liquid is circulated in such a manner. Note that the graph illustrated in FIG. 10 is example data on a change in the discharge speed with length of the pulse width, acquired for each of a plurality of different initial pressures.

FIG. 10 illustrates the speeds of the liquid discharged from one individual liquid chamber 6 when the initial pressure on the liquid is intentionally changed from SP1 to SP and to SP3 in that individual liquid chamber 6. As illustrated in the figure, the change in the liquid discharge speed Vj with length of the pulse width Pw varies depending on the initial pressure, and the differences among the discharge speeds Vj with the respective initial pressures is large at the timings of the resonance peak speed or the resonance opposite-peak speed.

Figure 11:
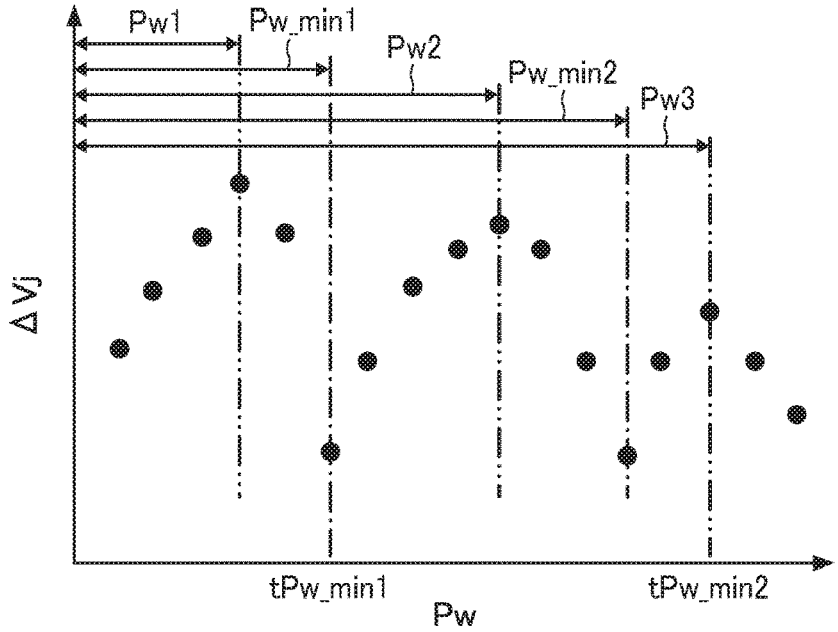
FIG. 11 is a chart illustrating example changes in difference in discharge speed with the pulse width for each initial pressure.

Here, a largest difference among the discharge speeds Vj with the respective initial pressures is referred to as "discharge speed difference ΔVj". FIG. 11 illustrates changes in the discharge speed difference ΔVj depending on duration of application of the voltage V1 (the pulse width Pw), based on the data in FIG. 10. In FIG. 11, timings tPw_min1 and tPw_min2, indicated by alternate long and short dashed lines, represent time point at which the discharge speed difference ΔVj reaches local minimums from the start of application of the voltage V1, and durations Pw_min1 and Pw_min2 represent the length of the pulse width Pw. The timing at which the difference in discharge speed is a local minimum is an inflection point. This also applies to the subsequent descriptions.

In this manner, the inventor has found that, when the liquid is discharged from the individual liquid chamber 6 with a drive waveform in which the pulse width Pw is set to the duration Pw_min1 or Pw_min2, the differences among the discharge speeds Vj with differences in the initial pressures can be reduced.

In the present embodiment, the drive waveform 110 in which the pulse with Pw is to the duration Pw_min1 or Pw_min2 is applied to the circulation-type liquid discharge head 404. The pulse width Pw set to the duration Pw_min1 or Pw__min2 for reducing the difference among the discharge speed Vj with the initial pressures can act similarly on a plurality of individual liquid chambers that are different in pressure loss. Therefore, setting the pulse widths to such lengths is advantageous in reducing variations in the discharge speed Vj among the individual liquid chambers in the circulation-type liquid discharge head.

The timings timings tPw__min1 and tPw__min2 are examples of "predetermined timing at which a difference in discharge speed of the liquid (caused when the initial pressure is changed in a case where the predetermined drive waveform is applied in a state where the initial pressure is applied to the liquid) is minimized". The pulse width Pw set to the duration Pw__min1 or Pw__min2 is an example pulse width to set, to a local minimum, the liquid discharge speed difference due to differences in initial pressure on the liquid in the individual liquid chamber. The pulse width Pw set to the duration Pw_min1 is an example satisfying a condition expressed by Expression 1.

$$Pw_vp1<Pw<Pw_va1 \qquad \text{Expression 1}$$

where Pw represents the pulse width, Pw_vp1 represents the duration of application of the voltage V1 (having the second potential) to when the discharge speed reaches the first resonance peak speed, and Pw_va1 represents the duration of application of the voltage V1 to when the discharge speed reaches the first resonance opposite-peak speed.

Further, the pulse width Pw set to the duration Pw_min2 is an example satisfying the condition expressed by Expression 2.

$$Pw_va1<Pw<Pw_vp2 \qquad \text{Expression 2}$$

where Pw_va1 represents the duration of application of the voltage V1 to when the discharge speed reaches the resonance opposite-peak speed, and Pw_vp2 represents the duration of application of the voltage V1 to when the discharge speed reaches the second resonance peak speed.

To intentionally change the initial pressure applied to the liquid in the individual liquid chamber 6, for example, the hydraulic head difference between the supply tank 512 and the liquid discharge head 404 is changed.

The initial pressure applied to the liquid in the individual liquid chamber 6 may be referred to as "initial meniscus pressure". That is, the pulse widths Pw set to the durations Pw__min1 and Pw__min2, respectively, are also examples of "pulse width with which the difference in the liquid discharge speed due to the initial meniscus pressure difference becomes the local minimum". The meniscus is an interface (liquid surface) between the liquid and gas at the nozzle 4. Further, the initial meniscus pressure is pressure applied to the meniscus in a state in which no drive waveform is applied. For example, the pulse width (duration of application of the second potential to the predetermined timing) can be set by the manufacturer before shipment, based on the data on changes in the discharge speed with length of the pulse width, acquired for each of a plurality of different initial pressures.

As described above, according to the present embodiment, in the liquid discharge apparatus including the circulation-type liquid discharge head, variations in the discharge speed of the liquid among the individual liquid chambers can be reduced.

Figure 12:
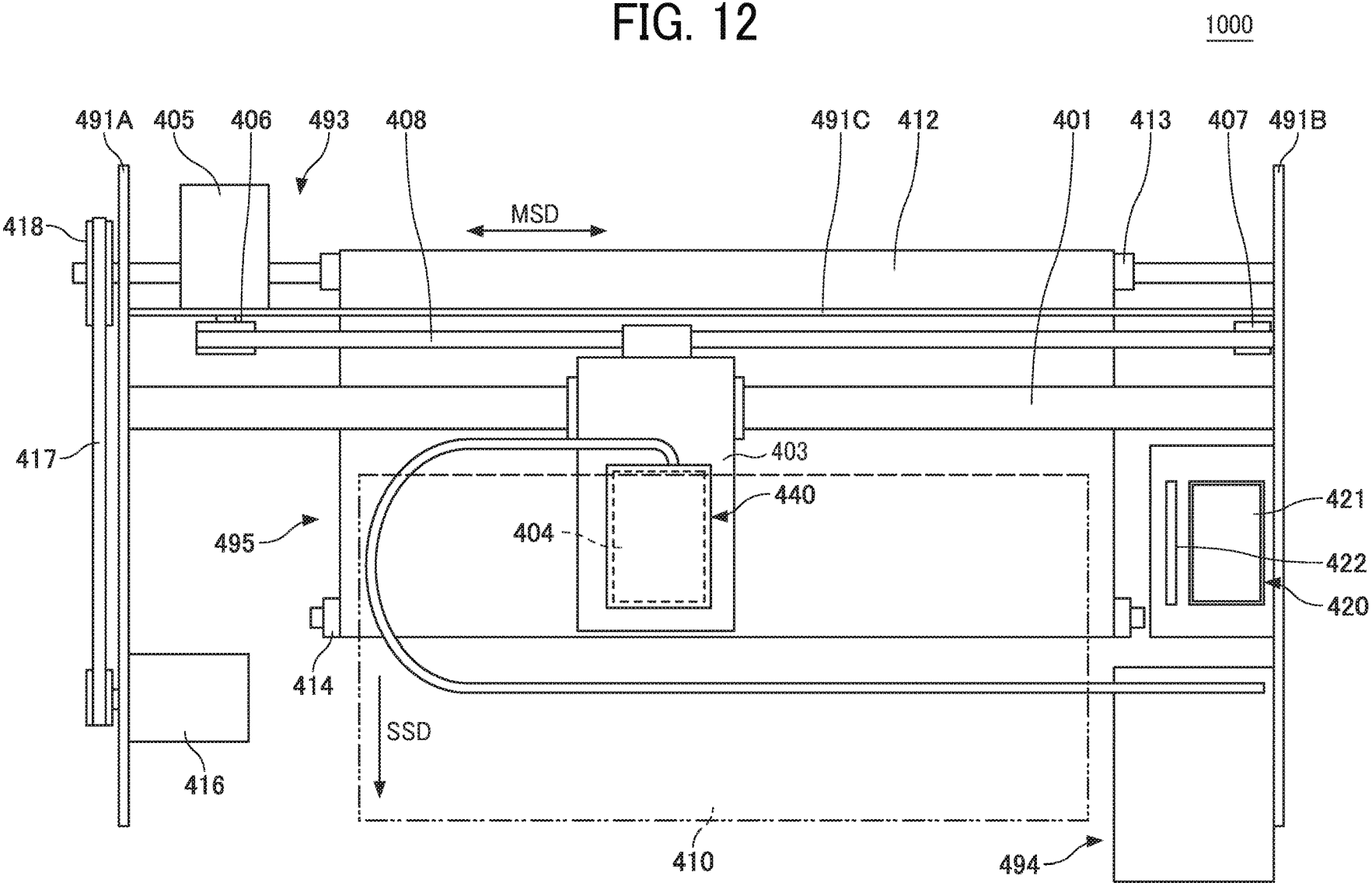
FIG. 12 is a plan view of a portion of a liquid discharge apparatus according to an embodiment.
Figure 13:
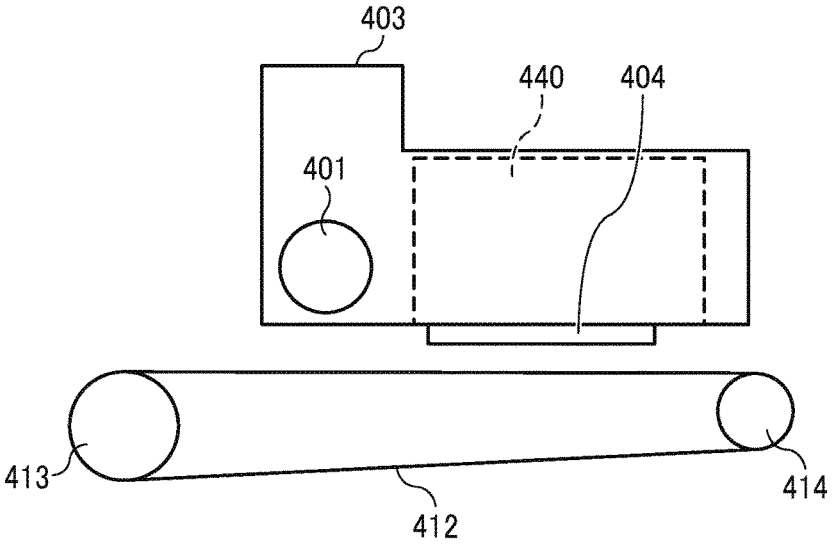
FIG. 13 is a side view of a portion of the liquid discharge apparatus illustrated in FIG. 12.

Next, descriptions are given below of an example liquid discharge apparatus according to an embodiment of the present disclosure, with reference to FIGS. 12 and 13. FIG. 12 is a plan view of a part of a liquid discharge apparatus 1000 according to an embodiment of the present disclosure. FIG. 13 is a side view of a part of the liquid discharge apparatus 1000 illustrated in FIG. 12.

The liquid discharge apparatus 1000 according to the present embodiment is a serial type apparatus in which a main scan moving unit 493 reciprocally moves a carriage 403 in a main scanning direction indicated by arrow MSD in FIG. 12. The main scan moving unit 493 includes, for example, a guide 401, a main scanning motor 405, and a timing belt 408. The guide 401 is bridged between a left side plate 491A and a right side plate 491B, to hold the carriage 403 movably. The main scanning motor 405 reciprocally moves the carriage 403 in the main scanning direction MSD via the timing belt 408 bridged between a driving pulley 406 and a driven pulley 407.

On the carriage 403, a liquid discharge device 440 including the liquid discharge head 404 according to an embodiment of the present disclosure is mounted. The liquid discharge head 404 of the liquid discharge device 440 discharges liquid of different colors, for example, yellow (Y), cyan (C), magenta (M), and black (K). The liquid discharge head 404 includes a plurality of nozzle arrays, each including a plurality of nozzles 4 (see FIG. 4) arrayed in row in a sub-scanning direction, which is indicated by arrow SSD in FIG. 12, perpendicular to the main scanning direction MSD. The liquid discharge head 404 is mounted on the carriage 403 so that liquid droplets are discharged downward.

The liquid stored outside the liquid discharge head 404 is supplied to the liquid discharge head 404 by the supply and circulation device 494. Referring also to FIG. 7, in this example, the supply and circulation device 494 includes the supply tank 512, the circulation tank 514, the compressor 516, the vacuum pump 518, the first liquid feed pump 520A, the second liquid feed pump 520B, and the regulator R. The supply-side pressure sensor 524 is disposed between the supply tank 512 and the liquid discharge head 404 and coupled to the supply channel coupled to the supply port 71 (see FIG. 1) of the liquid discharge head 404. The circulation-side pressure sensor 526 is disposed between the liquid discharge head 404 and the circulation tank 514 and is coupled to the circulation channel coupled to the circulation ports 81 (see FIG. 1) of the liquid discharge head 404.

The liquid discharge apparatus 1000 includes a conveyance unit 495 to convey a sheet 410. The conveyance unit 495 includes a conveyor belt 412 to convey the sheet 410 and a sub-scanning motor 416 to drive the conveyor belt 412.

The conveyor belt 412 attracts the sheet 410 and conveys the sheet 410 at a position facing the liquid discharge head 404. The conveyor belt 412 is an endless belt and is stretched between a conveyance roller 413 and a tension roller 414. The sheet 410 can be attracted to the conveyor belt 412 by electrostatic attraction, air suction, or the like.

As the conveyance roller 413 is rotated by the sub-scanning motor 416 via a timing belt 417 and a timing pulley 418, the conveyor belt 412 rotates in the sub-scanning direction SSD.

At one side in the main scanning direction MS) of the carriage 403, a maintenance unit 420 to maintain and recover the liquid discharge head 404 in good condition is disposed on a lateral side of the conveyor belt 412.

The maintenance unit 420 includes, for example, a cap 421 to cap a nozzle face (i.e., a face on which the nozzles 4 are formed) of the liquid discharge head 404 and a wiper 422 to wipe the nozzle face.

The main scan moving unit 493, the supply and circulation device 494, the maintenance unit 420, and the conveyance unit 495 are mounted to a housing that includes the left side plate 491A, the right side plate 491B, and a rear side plate 491C.

In the liquid discharge apparatus 1000 thus configured, the sheet 410 is fed to and attracted on the conveyor belt 412 and conveyed in the sub-scanning direction SSD as the conveyor belt 412 rotates.

While the carriage 403 moves in the main scanning direction MSD, the liquid discharge head 404 is driven in response to image signals, to discharge the liquid to the sheet 410 kept stationary, thus forming an image on the sheet 410.

As described above, the liquid discharge apparatus 1000 includes the liquid discharge head 404 according to an embodiment of the present disclosure, thus allowing stable formation of high quality images.

Figure 14:
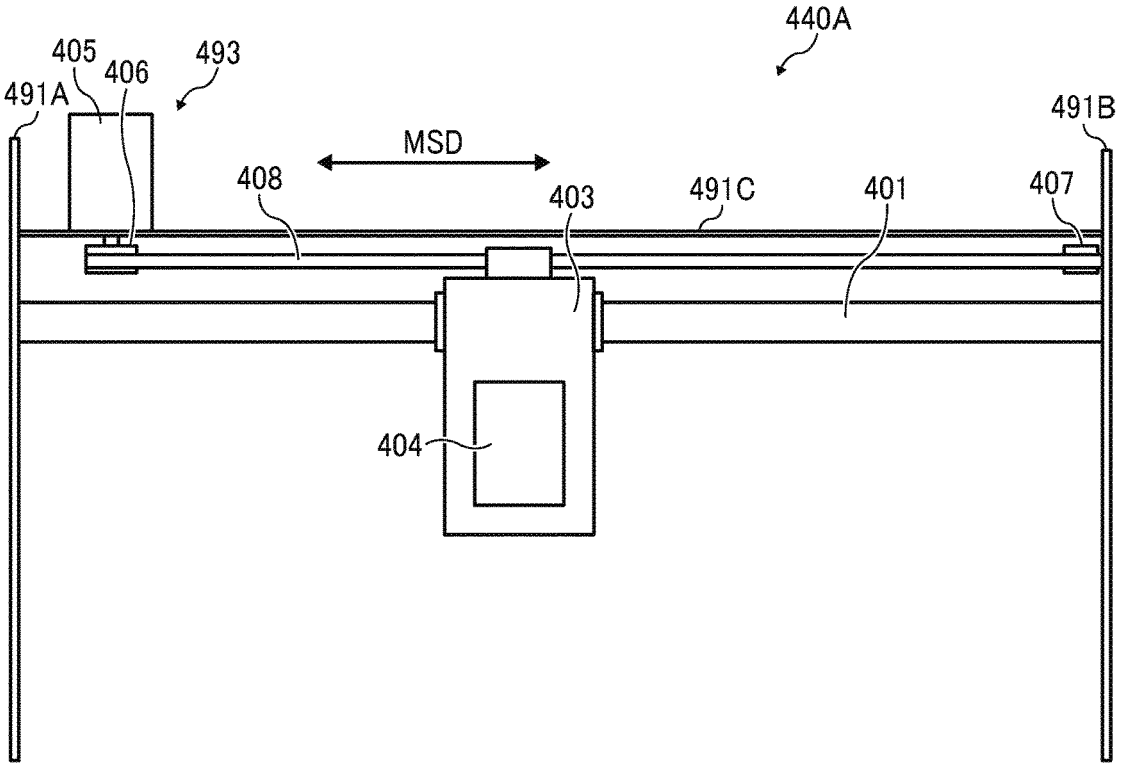
FIG. 14 is a plan view of a portion of a liquid discharge device according to another embodiment.

Next, a liquid discharge device 440A according to another embodiment of the present disclosure is described with reference to FIG. 14. FIG. 14 is a plan view of a portion of the liquid discharge device 440A.

The liquid discharge device 440A includes the housing, the main scan moving unit 493, the carriage 403, and the liquid discharge head 404 of components of the liquid discharge apparatus 1000. The left side plate 491A, the right side plate 491B, and the rear side plate 491C together form the housing.

Note that, in the liquid discharge device 440A, further, at least one of the maintenance unit 420 and the supply and circulation device 494 may be mounted, for example, on the right side plate 491B.

In the present disclosure, the "liquid discharge head" refers to a functional component configured to discharge liquid from a nozzle.

The liquid to be discharged from the nozzle of the liquid discharge head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

Examples of source to generate energy to discharge liquid include a piezoelectric actuator (a laminated piezoelectric element or a thin-film piezoelectric element), a thermal actuator that employs a thermoelectric conversion element, such as a heat element, and an electrostatic actuator including a diaphragm and opposed electrodes.

The term "liquid discharge device" represents a structure including the liquid discharge head and a functional part(s) or mechanism combined thereto. That is, "liquid discharge device" is an assembly of parts relating to liquid discharge. For example, the "liquid discharge device" may include a combination of the liquid discharge head with at least one of a supply and circulation device, a carriage, a maintenance unit, and a main scan moving unit.

Herein, the terms "combined" or "integrated" mean attaching the liquid discharge head and the functional parts (or mechanism) to each other by fastening, screwing, binding, or engaging and holding one of the liquid discharge head and the functional parts to the other movably relative to the other. The liquid discharge head may be detachably attached to the functional part(s) or unit(s).

Examples of the liquid discharge device further include a unit in which the liquid discharge head is combined with the supply and circulation device. In this case, the liquid discharge head and the supply and circulation device may be coupled to each other with a tube. Furthermore, a unit including a filter can be added at a position between the supply and circulation device and the liquid discharge head of the liquid discharge device.

In yet another example, the liquid discharge head and the carriage can be combined as "liquid discharge device".

As yet another example, the liquid discharge device is a unit in which the liquid discharge head and the main scanning moving unit are combined into a single unit. The liquid discharge head is movably held by a guide that is a part of the main scanning moving unit.

As yet another example, the liquid discharge device is a unit in which a cap that is a part of the maintenance unit is secured to the carriage mounting the liquid discharge head so that the liquid discharge head, the carriage, and the maintenance unit are combined as a single unit.

Further, in another example, a tube is coupled to the liquid discharge head mounting either the supply and circulation device or the channel member so that the liquid discharge head and the supply and circulation device are combined into a liquid discharge device. Through this tube, the liquid stored in a liquid container is supplied to the liquid discharge head.

The main scan moving mechanism may be a guide only. The supply unit can be a tube(s) only or a loading unit only.

In the above-described embodiments, the liquid discharge apparatus includes the liquid discharge head or the liquid discharge device and drives the liquid discharge head to discharge liquid. The term "liquid discharge apparatus" used here includes, in addition to apparatuses to discharge liquid to materials to which the liquid can adhere, apparatuses to discharge the liquid into gas (air) or liquid.

The liquid discharge apparatus may include at least one of devices to feed, convey, and discharge the material to which liquid can adhere. The liquid discharge apparatus may further include at least one of a pretreatment apparatus and a post-treatment apparatus.

As the liquid discharge apparatuses, for example, there are image forming apparatuses to discharge ink onto sheets to form images and three-dimensional fabricating apparatuses to discharge molding liquid to a powder layer in which powder is molded into a layer-like shape, so as to form three-dimensional fabricated objects.

The "liquid discharge apparatus" is not limited to an apparatus to discharge liquid to visualize meaningful images, such as letters or figures. For example, the liquid discharge apparatus may be an apparatus to form meaningless images, such as meaningless patterns, or fabricate meaningless three-dimensional images.

The above-mentioned term "material to which liquid can adhere" represents a material which liquid can, at least temporarily, adhere to and solidify thereon, or a material into which liquid permeates. Examples of "material to which liquid can adhere" include paper sheets, recording media such as recording sheet, recording sheets, film, and cloth; electronic components such as electronic substrates and piezoelectric elements; and media such as powder layers, organ models, and testing cells. The term "material to which liquid can adhere" includes any material to which liquid adheres, unless particularly limited.

The above-mentioned "material to which liquid adheres" may be any material, such as paper, thread, fiber, cloth, leather, metal, plastic, glass, wood, ceramics, or the like, as long as liquid can temporarily adhere.

The "liquid discharge apparatus" may be an apparatus in which the liquid discharge head and a material to which liquid can adhere move relatively to each other. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the sheet with the treatment liquid to reform the sheet surface and an injection granulation apparatus to discharge a composition liquid including a raw material dispersed in a solution from a nozzle to mold particles of the raw material.

The terms "image formation", "recording", "printing", "image printing", and "fabricating" used herein are synonymous with each other.

Figure 15:
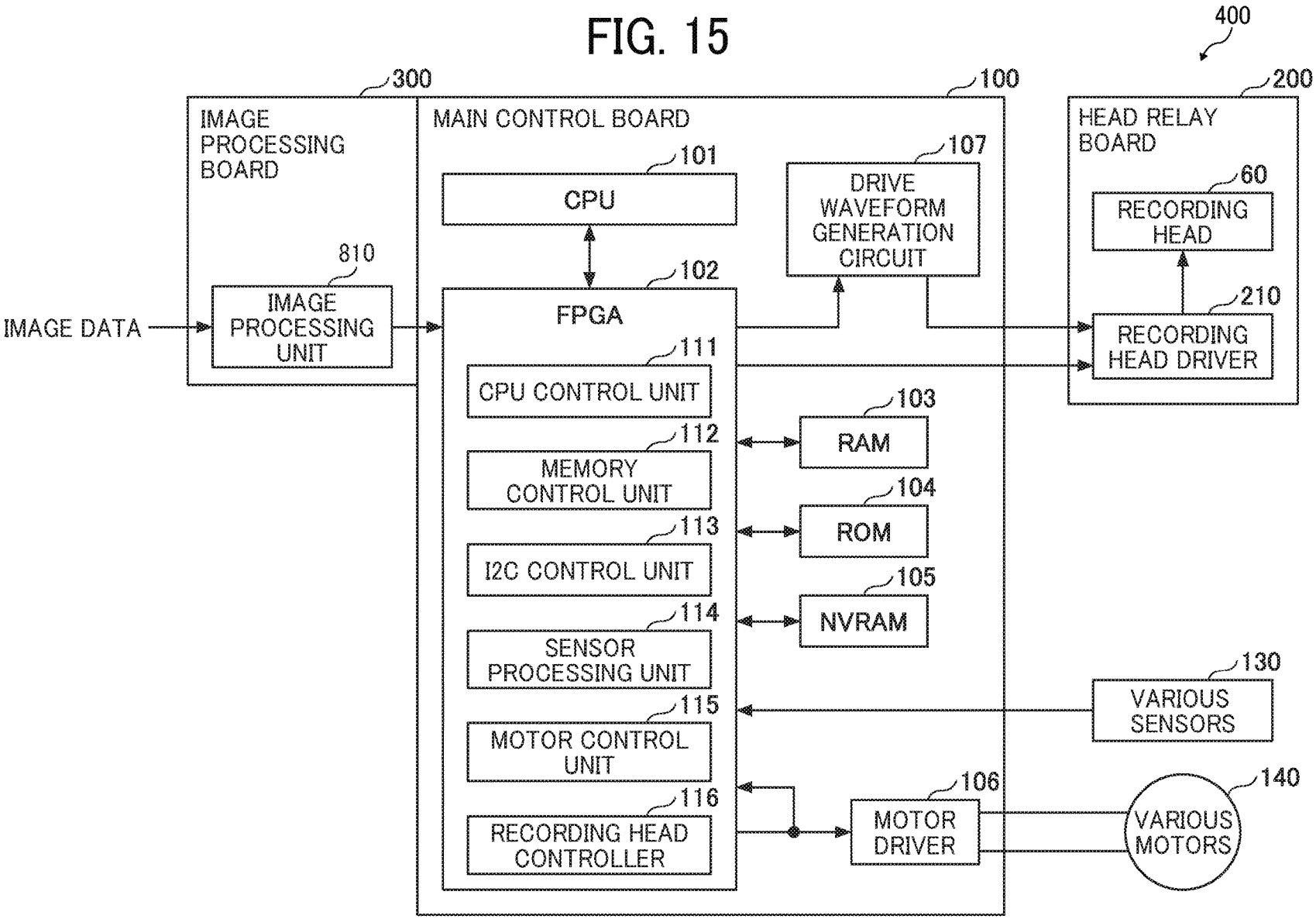
FIG. 15 is a block diagram illustrating a hardware configuration of an image forming apparatus according to an embodiment.

FIG. 15 is a schematic block diagram illustrating a hardware configuration of an image forming apparatus 400 according to an embodiment.

The "recording head" described below is synonymous with the "liquid discharge head". The image forming apparatus 400 includes a main control board 100, a head relay board 200, and an image processing board 300.

On the main control board 100, a central processing unit (CPU) 101, a field-programmable gate array (FPGA) 102, a random access memory (RAM) 103, a read only memory (ROM) 104, a non-volatile random access memory (NVRAM) 105, a motor driver 106, a drive waveform generation circuit 107, and the like are mounted.

The CPU 101 controls the entire image forming apparatus 400.

For example, the CPU 101 uses the RAM 103 as a work area to execute various control programs stored on the ROM 104 in order to output a control command to control each operation in the image forming apparatus 400.

At this time, while communicating with the FPGA 102, the CPU 101 cooperates with the FPGA 102 to control various operations in the image forming apparatus 400.

The FPGA 102 includes a CPU control unit 111, a memory control unit 112, an inter-integrated circuit (I2C) control unit 113, a sensor processing unit 114, a motor control unit 115, and a recording head controller 116.

The CPU control unit 111 functions to communicate with the CPU 101.

The memory control unit 112 functions to access the RAM 103 and the ROM 104.

The I2C control unit 113 functions to communicate with the NVRAM 105.

The sensor processing unit 114 processes sensor signals from various sensors 130.

The various sensors 130 are generic names of sensors that detect various states in the image forming apparatus 400.

In addition to an encoder sensor, the various sensors 130 includes a sheet sensor to detect the passage of a recording sheet, a cover sensor to detect opening of a cover, a temperature and humidity sensor to detect ambient temperature and humidity, a sensor to detect the state of a lever to secure the recording sheet, and an ink amount sensor to detect the amount of ink remaining in the cartridge.

Note that an analog sensor signal output from the temperature and humidity sensor or the like is converted into a digital signal by an analog-to-digital (AD) converter mounted, for example, on the main control board 100 and input to the FPGA 102.

The motor control unit 115 controls various motors 140.

The various motors 140 are generic names of motors included in the image forming apparatus 400.

The various motors 140 includes a main scanning motor to drive the carriage 403, a sub-scanning motor to convey the recording sheet in the sub scanning direction, a sheet feeding motor to feed the recording sheet, and a maintenance motor to drive the maintenance unit 420.

Descriptions are given below of control of the main scanning motor 405 (see FIG. 12), as an example control by cooperation between the CPU 101 and the motor control unit 115 of the FPGA 102.

First, the CPU 101 notifies the motor control unit 115 of an instruction to start operation of the main scanning motor 405 and the travel speed and the travel distance of the carriage 403.

In response to a reception of such an instruction, the motor control unit 115 generates a drive profile, based on the travel speed and information on the operation start instruction notified from the CPU 101, calculates a pulse-width modulation (PWM) command value while performing comparing with an encoder value supplied from the sensor processing unit 114 (obtained from processing of the sensor signal from the encoder sensor), and outputs the PWM command value to the motor driver 106.

Upon completion of the predetermined operation, the motor control unit 115 notifies the CPU 101 of the completion of the operation.

Although the description above concerns the example in which the motor control unit 115 generates the drive profile, alternatively, the CPU 101 can be configured to generate the drive profile and transmits an instruction to the motor control unit 115.

Further, the CPU 101 counts the number of printed sheets, the number of scanning of the main scanning motor 405, and the like.

Figure 17:
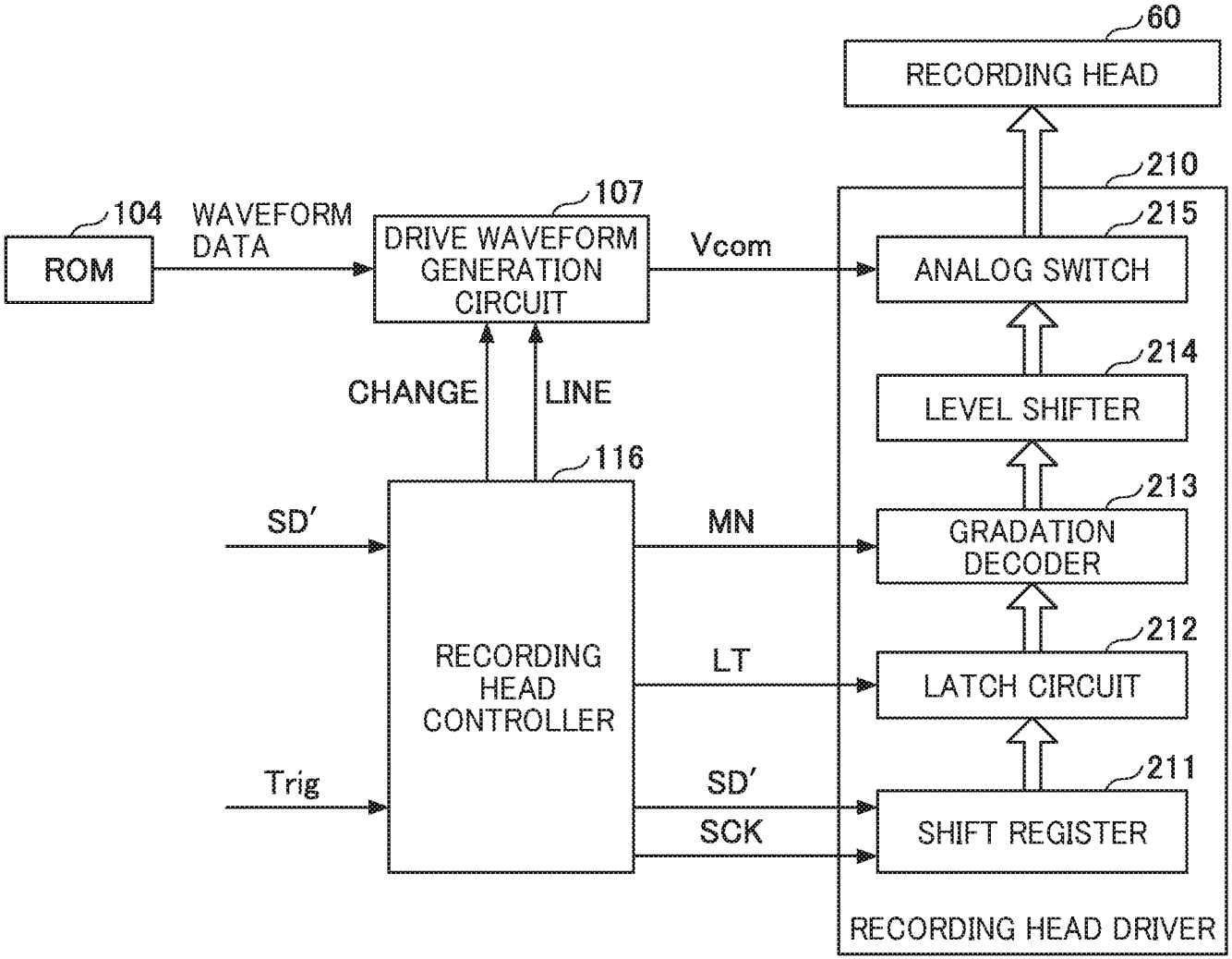
FIG. 17 is a block diagram illustrating an example configuration of a recording head controller, a drive waveform generation circuit, and a recording head driver of the configuration illustrated in FIG. 15.

Referring also to FIG. 17, the recording head controller 116 transmits head drive data, a discharge synchronization signal LINE, and a discharge timing signal CHANGE stored in the ROM 104 to the drive waveform generation circuit 107 to cause the drive waveform generation circuit 107 to generate a common drive waveform signal Vcom.

The common drive waveform signal Vcom generated by the drive waveform generation circuit 107 is input to a recording head driver 210 to be described later, mounted on the head relay board 200.

Figure 16:
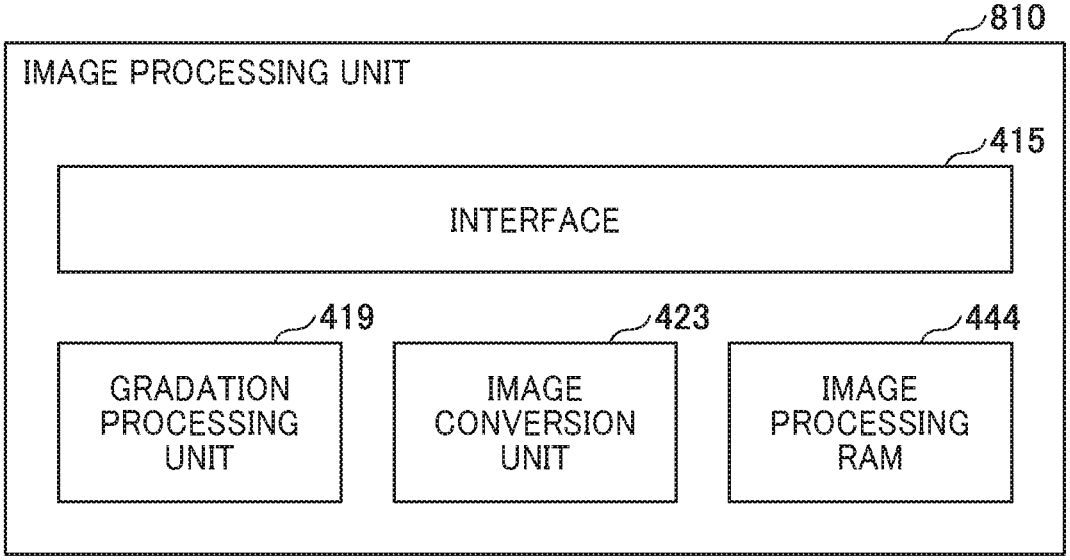
FIG. 16 is a schematic block diagram of a configuration of an image processing unit of the image forming apparatus illustrated in FIG. 15.

FIG. 16 is a functional block diagram illustrating an example configuration of an image processing unit 810.

The image processing unit 810 performs gradation processing, image conversion processing, and the like on the received image data and converts the received image data into image data in a format that can be processed by the recording head controller 116. Then, the image processing unit 810 outputs the converted image data to the recording head controller 116.

More specifically, the image processing unit 810 includes an interface 415, a gradation processing unit 419, an image conversion unit 423, and an image processing RAM 444.

The interface 415 is an input unit of image data and is a communication interface with the CPU 101 and the FPGA 102. The gradation processing unit 419 performs gradation processing on accepted multivalued image data and converts the image data into small-value image data. The small-value image data is image data of a gradation number equal to the type (large droplet, medium droplet, and small droplet) of the droplets discharged by a recording head 60 illustrated in FIGS. 15 and 17. Then, the gradation processing unit 419 holds the converted image data for one band or more on the image processing RAM 444.

The image data for one band represents image data corresponding to the maximum width in the sub-scanning direction that the recording head 60 can record in one scanning in the main scanning direction.

The image conversion unit 423 converts the image data of one band on the image processing RAM 444 in a unit of one image to be output in one scanning in the main scanning direction. This conversion is performed in accordance with the configuration of the recording head 60, according to the information of the printing order and the printing width (the width of image recording per scanning in the sub-scanning direction) received from the CPU 101 via the interface 415.

The printing order and the printing width can be one-pass printing in which the recording medium is scanned once in the main scanning direction for forming an image or, alternatively, multi-pass printing in which the same area of the recording medium is scanned a plurality of times in the main scanning direction with the same nozzle group or different nozzle groups for forming an image. Alternatively, a plurality of heads can be arrayed in the main scanning direction to discharge liquid to the same area with different nozzles. These recording methods can be appropriately combined.

The term "printing width" is the width of the image in the sub-scanning direction to be printed in one scan of the recording head 60 in the main scanning direction. In the present embodiment, the CPU 101 sets the printing width.

Referring also to FIG. 17, the image conversion unit 423 outputs converted image data SD' to the image processing RAM 444 via the interface 415.

The function of the image processing unit 810 can be executed by hardware such as an FPGA or ASIC or by an image processing program stored in a memory inside the image processing unit 810.

In addition, the function of the image processing unit 810 can be implemented not by an internal configuration of the image forming apparatus but by software installed in a computer.

FIG. 17 is a block diagram illustrating an example configuration of the recording head controller 116, the drive waveform generation circuit 107, and the recording head driver 210.

In response to a reception of a trigger signal Trig that triggers liquid discharging, the recording head controller 116 outputs the discharge synchronization signal LINE that triggers generation of the drive waveform, to the drive waveform generation circuit 107. Further, outputs the discharge timing signal CHANGE equivalent to the amount of delay from the discharge synchronization signal LINE to the drive waveform generation circuit 107.

To the drive waveform generation circuit 107, drive waveform data retrieved from the ROM 104 is transmitted. The drive waveform generation circuit 107 generates the common drive waveform signal Vcom at the timing based on the discharge synchronization signal LINE and the discharge timing signal CHANGE.

Further, the recording head controller 116 receives the image data SD' after the image processing from the image processing unit 810 on the image processing board 300, and, based on the image data SD', generates a mask control signal MN. The mask control signal MN is for selecting a waveform of the common drive waveform signal Vcom according to the size of the ink droplet to be discharged from each nozzle of the recording head 60.

The mask control signal MN is a signal at a timing synchronized with the discharge timing signal CHANGE Then, the recording head controller 116 transmits the image data SD', a synchronization clock signal SCK, a latch signal LT instructing latch of the image data, and the generated mask control signal MN to the recording head driver 210.

As illustrated in FIG. 17, the recording head driver 210 includes a shift register 211, a latch circuit 212, a gradation decoder 213, a level shifter 214, and an analog switch 215.

The shift register 211 receives the image data SD' and the synchronization clock signal SCK transmitted from the recording head controller 116.

The latch circuit 212 latches each value on the shift register 211 according to the latch signal LT transmitted from the recording head controller 116.

The gradation decoder 213 decodes the value (image data SD') latched by the latch circuit 212 and the mask control signal MN and outputs the result. The level shifter 214 converts the level of a logic level voltage signal of the gradation decoder 213 to a level at which the analog switch 215 can operate.

The analog switch 215 is turned on and off by the output received from the gradation decoder 213 via the level shifter 214.

The analog switch 215 is provided for each nozzle of the recording head 60 and is coupled to an individual electrode of a piezoelectric element corresponding to each nozzle.

In addition, to the analog switch 215, the common drive waveform signal Vcom from the drive waveform generation circuit 107 is input.

In addition, as described above, the timing of the mask control signal MN is synchronized with the timing of the common drive waveform signal Vcom. Therefore, the analog switch 215 is switched between on and off timely in accordance with the output from the gradation decoder 213 via the level shifter 214. With this operation, the waveform to be applied to the piezoelectric element corresponding to each nozzle is selected from the drive waveforms forming the common drive waveform signal Vcom. As a result, the size of the ink droplet discharged from the nozzle is controlled.

Embodiment 2

In Embodiment 1 described above, the hydraulic head difference between the supply tank 512 and the liquid discharge head 404 is changed to intentionally vary the initial pressure applied to the liquid in the individual liquid chamber 6.

At that time, the hydraulic head pressure can be measured while changing the hydraulic head difference, and the initial pressure applied to the liquid in the individual liquid chamber 6 can be grasped. Alternatively, a pressure sensor can be disposed inside one individual liquid chamber 6 targeted, to measure the pressure therein, thereby grasping the initial pressure applied to the liquid in the individual liquid chamber 6.

Yet alternatively, a pressure sensor can be disposed inside the common liquid chamber 10, to measure the pressure therein, thereby grasping the initial pressure applied to the liquid in the individual liquid chamber 6. Since the common liquid chamber 10 is larger than the individual liquid chamber 6, use of the common liquid chamber 10 can alleviate restrictions on the size of the pressure sensor disposed therein.

When the initial pressure applied to the liquid in the individual liquid chamber 6 is measured and quantitatively grasped, for example, the pulse width to minizine the liquid discharge speed difference due to differences in initial pressure on the liquid in the individual liquid chamber can be efficiently obtained.

The effects other than those described above are the same as those described in Embodiment 1.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge device comprising:

a nozzle plate, including a plurality of nozzles configured to discharge liquid;

a plurality of individual liquid chambers, each of the plurality of individual liquid chambers respectively communicating with a respective one of the plurality of nozzles;

a common liquid chamber, configured to supply the liquid to the plurality of individual liquid chambers;

a circulation channel, to communicate with the plurality of individual liquid chambers;

a common circulation chamber, to communicate with the circulation channel;

a pressure generator, configured to apply pressure to the liquid in each of the plurality of individual liquid chambers; and circuitry configured to apply, to the pressure generator, a drive waveform to change an electric potential from a first potential for applying an initial pressure to the liquid in each of the plurality of individual liquid chambers to a second potential, different from the first potential, and to maintain the second potential for a time period, and to change the electrical potential to a potential for discharging the liquid, a difference in discharge speed of the liquid, being a local minimum at a beginning and for a duration of the time period, being caused by changing pressure from the initial pressure upon the drive waveform being applied, and the initial pressure being pressure applied to the liquid in a state before application of the drive waveform.

2. The liquid discharge device of claim 1, wherein a pulse width, being the duration of the time period during which the second potential is maintained, is determined based on data relating to a change in the discharge speed in relation to a length of the pulse width, acquired for each of a plurality of different initial pressures.

3. The liquid discharge device of claim 2, wherein the discharge speed varies according to the pulse width.

4. A liquid discharge apparatus comprising the liquid discharge device of claim 2.

5. The liquid discharge device of claim 1, wherein the discharge speed periodically reaches a peak and an opposite peak during application of the second potential, and wherein a pulse width, being the duration of the time period during which the second potential is maintained, satisfies:

$$Pw_vp1<Pw<Pw_va1$$

where Pw represents the pulse width, Pw_vp1 represents a duration of application of the second potential to when the discharge speed reaches a first peak, and Pw_va1 represents a duration of application of the second potential to when the discharge speed reaches a first opposite peak.

6. A liquid discharge apparatus comprising the liquid discharge device of claim 5.

7. The liquid discharge device of claim 1, wherein the discharge speed periodically reaches a peak and an opposite peak during application of the second potential, and wherein a pulse width, being the duration of the time period during which the second potential is maintained, satisfies:

$$Pw_va1<Pw<Pw_vp2$$

where Pw represents the pulse width, Pw_va1 represents a duration of application of the second potential to when the discharge speed reaches a first opposite peak, and Pw_vp2 represents a duration of application of the second potential to when the discharge speed reaches a second peak.

8. A liquid discharge apparatus comprising the liquid discharge device of claim 7.

9. A liquid discharge apparatus comprising the liquid discharge device of claim 1.

10. A liquid discharge device comprising:

a nozzle plate including a plurality of nozzles configured to discharge liquid;

a plurality of individual liquid chambers each of the plurality of individual liquid chambers respectively communicating with a respective one of the plurality of nozzles;

a common liquid chamber configured to supply the liquid to the plurality of individual liquid chambers;

a circulation channel to communicate with the plurality of individual liquid chambers;

a common circulation chamber to communicate with the circulation channel;

a pressure generator configured to apply pressure to the liquid in each of the plurality of individual liquid chambers; and circuitry configured to apply, to the pressure generator, a drive waveform to change an electric potential from a first potential for applying an initial pressure to the liquid in each of the plurality of individual liquid chambers to a second potential different from the first potential, to maintain the second potential for a time period, and to change the electrical potential to a potential for discharging the liquid, a difference in discharge speed of the liquid being a local minimum at a beginning and for a duration of the time period, and being caused by a difference in an initial meniscus pressure, and the initial meniscus pressure being pressure applied to an interface between the liquid and gas at each of the plurality of nozzles in a state without application of the drive waveform.

11. The liquid discharge device of claim 10, wherein a pulse width, being the duration of the time period during which the second potential is maintained, is determined based on data relating to a change in the discharge speed in relation to a length of the pulse width, acquired for each of a plurality of different initial pressures.

12. The liquid discharge device of claim 10, wherein the discharge speed periodically reaches a peak and an opposite peak during application of the second potential, and wherein a pulse width, being the duration of the time period during which the second potential is maintained, satisfies:

$$Pw_vp1<Pw<Pw_va1$$

where Pw represents the pulse width, Pw_vp1 represents a duration of application of the second potential to when the discharge speed reaches a first peak, and Pw_va1 represents a duration of application of the second potential to when the discharge speed reaches a first opposite peak.

13. The liquid discharge device of claim 10, wherein the discharge speed periodically reaches a peak and an opposite peak during application of the second potential, and wherein a pulse width, being the duration of the time period during which the second potential is maintained, satisfies:

$$Pw_va1<Pw<Pw_vp2$$

where Pw represents the pulse width, Pw_va1 represents a duration of application of the second potential to when the discharge speed reaches a first opposite peak, and Pw_vp2 represents a duration of application of the second potential to when the discharge speed reaches a second peak.

14. A liquid discharge apparatus comprising the liquid discharge device of claim 10.

* * * * *